United States Patent [19]

Slaats

[11] 4,025,313

[45] May 24, 1977

[54] ROLLED STOCK OF POWDER METALLURGICALLY-FORMED, NONDUCTILE MATERIAL AND METHOD OF PRODUCTION

[75] Inventor: Hendrick J. Slaats, Attleboro, Mass.

[73] Assignee: Texas Instruments Incorporated, Dallas, Tex.

[22] Filed: July 24, 1974

[21] Appl. No.: 491,591

[52] U.S. Cl. ..... 428/584; 75/208 CS

[51] Int. Cl.[2] ..... B22F 7/00

[58] Field of Search ..... 29/182.2, 182.3; 75/208 R, 208 CS

[56] References Cited

UNITED STATES PATENTS

| | | | |
|---|---|---|---|
| 3,146,099 | 9/1964 | Teja | 75/208 CS |
| 3,489,531 | 1/1970 | Schreiner | 29/182.2 |
| 3,538,550 | 11/1970 | Dürrwächter | 75/208 |
| 3,560,170 | 2/1971 | Dürrwächter | 29/182.2 |
| 3,666,456 | 5/1972 | Haller | 75/208 |

*Primary Examiner*—Verlin R. Pendegrass
*Assistant Examiner*—Donald P. Walsh
*Attorney, Agent, or Firm*—Harold Levine; John A. Haug; James P. McAndrews

[57] ABSTRACT

Rolled stock of a relatively nonductile material and a powder metallurgical method for its production. A precompact is formed including a body of powder of said nonductile material with generally parallel borders of a ductile metal powder compatible with the nonductile material along two side edges thereof. The precompact is compressed to form a compact of said nonductile metal with borders of said ductile metal and having two generally parallel faces extending between the outside edges thereof. The compact is sintered to form a bordered ingot which is then rolled in a direction parallel to its borders by applying rolling force to its faces. Initiation of edge cracks during the rolling operation is thereby inhibited.

8 Claims, 4 Drawing Figures

ROLLED STOCK OF POWDER METALLURGICALLY-FORMED, NONDUCTILE MATERIAL AND METHOD OF PRODUCTION

BACKGROUND OF THE INVENTION

This invention relates to the field of powder metallurgy and more particularly to an improved method for producing rolled stock of a relatively nonductile material with minimum incidence of edge cracking from the rolling operation.

Powder metallurgical techniques are commonly used in forming certain types of materials such as refractory metals, superhard materials and nonductile materials. Powder metallurgy finds important use in the forming of integral parts from intimate mixtures of powdered metals and dispersed nonmetals, such as the silver/cadmium oxide material used in electrical contacts.

The essential steps of a powder metallurgical forming technique are compression of a powder to form a compact (in which the powder particles are "green" or partially bonded) and sintering of the compact (to perfect the "green" or partial bonding) to provide a cohesive integral bonded mass. In many instances, the final product is one having the conformation and dimensions of the sintered compact and the forming technique is thus complete upon sintering. In other instances, however, the sintered compact constitutes an ingot which is further processed by various finishing techniques to provide the final product form. In the case of silver/cadmium oxide contact material, for instance, a sintered silver/cadmium oxide ingot may be rolled to provide a sheet or strip from which contact "buttons" are stamped. Where nonductile or brittle materials are involved, the stresses of rolling frequently induce cracking at the edges of the rolled or partially rolled sheet or strip. As a consequence, rolling is impractical or at least involves production of inordinate amounts of cracked stock which must be scrapped.

SUMMARY OF THE INVENTION

It is an object of the present invention, therefore, to provide a practical powder metallurgical method for producing rolled stock of a relatively nonductile material. It is a particular object of this invention to provide such a method which inhibits or avoids the initiation and propagation of edge cracks in the stock during the rolling operation. It is a further object of the invention to provide such a method which allows a substantial thickness reduction without excessive cracking of the stock. Other objects and features will be in part apparent and in part pointed out hereinafter.

Briefly, the present invention is directed to a powder metallurgical method for producing rolled stock of a relatively nonductile material. In this process, a precompact is provided including a body of powder of nonductile material with generally parallel borders of a ductile metal powder compatible with the material along two side edges thereof. The precompact is compressed to form a compact of the nonductile material with borders of the ductile metal and having two generally parallel faces extending between the outside edges thereof. The compact is sintered to form a bordered ingot which is then rolled in a direction parallel to the borders by applying rolling force to its faces whereby formation of edge cracks is inhibited during the rolling operation.

The invention is further directed to rolled stock comprising a strip of powder metallurgically-formed and sintered nonductile material. Along the side edges of the strip are borders of metallurgically-formed and sintered ductile metal compatible with said nonductile material.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
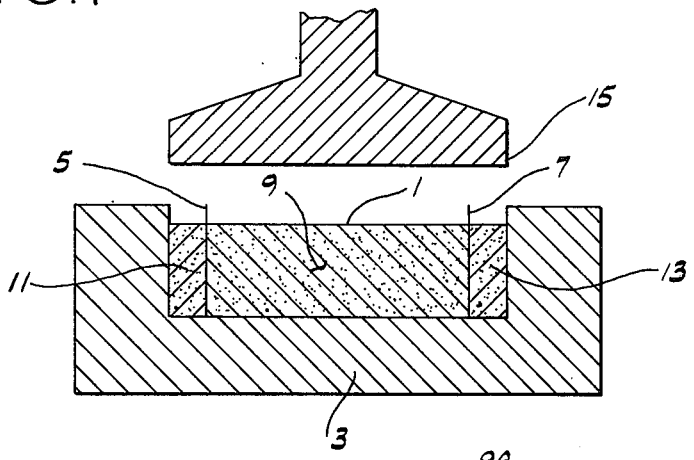
FIG. 1 is a schematic illustrating the formation and compression of the precompact in accordance with the method of the invention.

Referring to FIG. 1, a precompact is formed by charging or loading powder into a mold 3. Thin partitions 5 and 7 are positioned to define separate compartments in the mold into which the powder comprising a nonductile metal body or mass 9 and ductile metal borders 11 and 13 are respectively charged.

After both the nonductile and the ductile metal powders have been charged, partitions 5 and 7 are removed and the precompact 1 is compressed with a punch 15 to form a "green" compact. Conventional presures of up to 30 tons/sq. in. are applied, typically for up to 15 seconds. Alternatively, the compression may be carried out using a progressive forming technique in which a relatively thick bed of powder is advanced under a reciprocating tapered or curved ram. Advancement of the powder under the ram is intermittent and the dwell period of the powder coincides synchronously with the downward movement of the ram.

Figure 2:
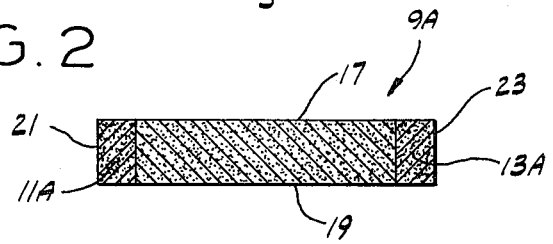
FIG. 2 is a lateral cross section showing the compressed and sintered ingot.

After the compression step, or simultaneously therewith, the compact is sintered to form a bordered ingot. Conventional sintering conditions are utilized in this step with a temperature of 1500° C. for one hour being suitable for silver/cadmium oxide contact material. The sintered ingot is depicted in FIG. 2 and incudes a body of nonductile material 9A having generally parallel borders of silver 11A and 13A along the side edges thereof. The ingot has generally parallel faces 17 and 19 extending between the outside edges 21 and 23.

The sintered ingot is rolled in direction parallel to borders 11A and 13A by application of rolling force on faces 17 and 19. The presence of the borders effectively inhibits the initiation and propagation of edge cracks in rolling operations involving thickness reductions of up to about 25%. Where a greater thickness reduction is necessary, the partially rolled stock should be annealed after each 25% reduction. When the stock has been rolled to the extent that its density is essentially equivalent to the density of its constituent material, however, somewhat greater size reduction, for example 50%, may be realized between annealing steps without excessive edge cracking.

Regardless of whether the stock is annealed in the course of rolling it is highly desirable to anneal the stock after rolling is completed. Although quite ductile when bent about a lateral axis, the unannealed rolled stock of silver/cadmium oxide made by powder metallurgy is brittle and will break if bent to approximately 15° about a longitudinal axis. After annealing, however, the stock exhibits satisfactory ductility in all directions.

Figure 3:
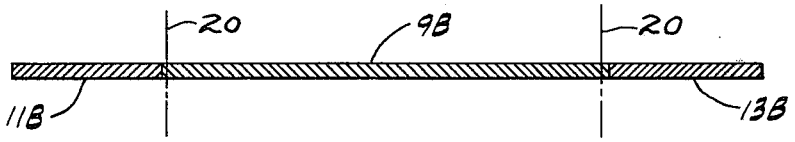
FIG. 3 is a cross section of the rolled stock obtained by rolling the ingot of FIG. 2.
Figure 4:
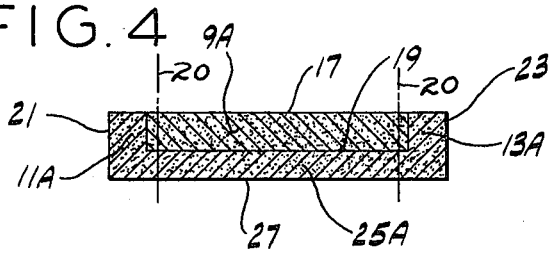
FIG. 4 is a sintered ingot formed in accordance with an alternative embodiment of the invention.

The rolled stock product of the invention is depicted in FIG. 3 and includes a strip of powder metallurgically-formed and sintered nonductile material such as silver/cadmium oxide with borders 9B and 11B of powder metallurgically-formed and sintered ductile metal such as silver. The strip may be formed of other relatively nonductile materials such as silver/nickel, silver/tungsten, copper/tungsten, or copper/molybdenum. If a copper/tungsten material is processed, the material must be maintained in a hydrogen atmosphere during sintering and annealing to avoid oxidation and to promote particle bonding. The border in each case is comprised of a ductile metal compatible with the powder materials from which the sheet is formed. The two materials are compatible if they form an adequate bond and neither the bond nor either of the materials is adversely affected by differences between the materials in their response to the powder metallurgical forming, sintering, rolling and annealing conditions. In particular, the border material must not melt at sintering or annealing temperatures nor be attacked at those temperatures by the atmosphere in which the nonductile material is maintained. Copper, e.g., is a suitable border material for producing copper/tungsten or copper/molybdenum strip. Normally the border of the rolled stock of the invention is sheared off along lines 20 as indicated in FIGS. 3 and 4 before the strip of nonductile material is fabricated into a final product. The border material so removed can be recycled, reduced to powder, and used as border material in the further production of rolled stock.

FIG. 4 illustrates an alternative embodiment of the invention in which the sintered ingot is formed to include a continuous layer 25A of the ductile metal spanning or extending between borders 11A and 13A so that the body 9A is bordered on three sides by ductile metal. Rolling is carried out by application of rolling force to face 17 of body 9A and face 27 of border 25A. This configuration is particularly useful where the rolled stock of the invention is silver/cadmium oxide contact material. After the ingot of FIG. 4 has been rolled, contact buttons stamped from the resulting stock have both a silver/cadmium oxide face and a silver face which facilitates bonding of the contacts to certain substrates.

The following examples illustrate the invention.

EXAMPLE 1

A precompact was prepared by placing a ¼ inch deep layer of silver metal powder in the bottom of a mold, positioning partitions consisting of 0.010 inch × 1 inch × 15 inches ferrous alloy stock ¼ inch away from and parallel to opposite sides of the mold, filling the spaces between the partitions and the mold walls with additional silver powder and providing a mass of 1–2$\mu$ silver/cadmium oxide powder between the two partitions. The silver/cadmium oxide powder had been prepared by coprecipitation from aqueous solution and calcining of the coprecipitate. After the mold was filled, the partitions were withdrawn and the precompact compressed with 450 tons of force (1.6 to 2.0 tons/cm.$^2$) to provide a green compact 2.570 inches wide by 15.0 inches long by 0.220 inch thick having a weight of 1084 g. and a density of 7.79 g./cm.$^3$. This compact was sintered at 820° C. for 2-½ hours to provide a silver bordered ingot weighing 1072 g., having a length of approximately 14.5 inches, a width of approximately 2.450 inches, a thickness of approximately 0.210 inches, and thus a density of approximately 8.70 g./cm.$^3$.

In the same fashion a second sintered ingot was prepared having essentially the same dimensions as the first ingot, with a weight of 1066 g. and a density of approximately 8.66 g./cm.$^3$.

EXAMPLE 2

Using a 5 inches diameter by 8 inches wide mill, a bordered ingot prepared as in Example 1 was cold-rolled from an initial thickness of 0.210 inch to a final sheet thickness of 0.013 inch in accordance with the following pass schedule:

| Pass | Thickness | Pass | Thickness |
|---|---|---|---|
| 1 | 0.183 | 12 | 0.069 |
| 2 | 0.165 | 13 | 0.060 |
| 3 | 0.152 | 14 | 0.051 |
| 4 | 0.142 | 15 | 0.043 |
| 5 | 0.133 | 16 | 0.034 |
| 6 | 0.124 | 17 | 0.026 |
| 7 | 0.115 | 18 | 0.022 |
| 8 | 0.106 | 19 | 0.018 |
| 9 | 0.097 | 20 | 0.016 |
| 10 | 0.088 | 21 | 0.013 |
| 11 | 0.078 | | |

No annealing was carried out at any time in the course of this run. Despite the absence of annealing, cracks did not appear in the bordered material until the thickness had been reduced to approximately 0.133 inch. Even when the final thickness of 0.013 inch had been reached, only tiny cracks had formed and these were confined to the silver border. Final trimmed width of the rolled stock was 2.100 inches. Under comparable conditions, significant edge cracking occurs in nonbordered ingots at a thickness of approximately 0.183 inch.

EXAMPLE 3

A sintered bordered ingot prepared as in Example 1 was cold-rolled in the manner described in Example 2. Cracking began to appear at a thickness of 0.140 inch whereupon the stock was annealed at 1500° F. for 30 minutes in air. Cold-rolling was then resumed until a thickness of 0.025 inch was reached. At this point, the edges were still in good condition, only slightly frayed in the silver borders. Only ¼ inch of the border needed to be trimmed off to eliminate such cracks as did appear.

EXAMPLE 4

A sintered bordered ingot was prepared and cold-rolled in the manner described in Example 3, except that the fine silver border was trimmed off prior to rolling. On the first pass, cracking started, and when a thickness of 0.075 inch had been reached, the stock was cracked one-quarter of the way in from each side, thus affording only about a 50% yield of useful strip material.

In view of the above, it will be seen that the several objects of the invention are achieved and other advantageous results attained.

As various changes could be made in the above methods and products without departing from the scope of the invention, it is intended that all matter contained in the above description or shown in the accompanying drawings shall be interpreted as illustrative and not in a limiting sense.

What is claimed is:

1. A powder metallurgical method for producing rolled stock of a relatively nonductile metal material which is free of edge cracks, said method comprising the steps of:

forming a precompact comprising a first body of powder of said nonductile metal material and two generally parallel bodies of powder of a ductile metal compatible with said nonductile material which extend along respective side edges of said first body of powder;

compressing said precompact to form a compact of said nonductile material having borders of said ductile metal extending along the side edges thereof and having two generally parallel faces extending between said side edges thereof;

sintering said compact to form a bordered ingot;

rolling the bordered ingot in a direction parallel to said borders by applying rolling force to said generally parallel faces whereby the thickness of said ingot is reduced while formation of edge cracks in said nonductile material is inhibited during said rolling; and trimming said borders from said ingot to form said rolled stock, 2. A method as set forth in claim 1 wherein the precompact is formed to include a continuous layer of said ductile metal powder extending between the aforesaid two bodies of ductile metal powder along a third side of the body of nonductile material powder and whereby said precompact is compressed to form said compact with said ductile metal borders and with a layer of said ductile metal powder extending along one of said generally parallel faces of said compact.

3. A method as set forth in claim 1 wherein said precompact is formed by charging said nonductile material powder and said ductile metal powder into a mold, and the precompact in the mold is compressed by a die to form said compact.

4. A method as set forth in claim 3 wherein thin partitions are positioned in the mold to define separate compartments to which the nonductile material powder and the ductile metal powder are respectively charged.

5. A method as set forth in claim 1 wherein the bordered ingot is annealed after rolling to increase its ductility.

6. A method as set forth in claim 1 wherein the bordered ingot is annealed after its thickness has been reduced by no more than about 25% and rolling is resumed after said annealing to effect further reduction in the thickness of the bordered ingot.

7. A method as set forth in claim 1 wherein sid nonductile material comprises a silver/cadmium oxide powder and said ductile metal comprises a fine silver metal powder.

8. Rolled stock prepared by a method comprising the steps of:

forming a precompact comprising a first body of powder of nonductile metal material and two generally parallel bodies of powder of a ductile metal compatible with said nonductile material which extend along respective side edges of the first body of powder;

compressing said precompact to form a compact of said nonductile material having borders of said ductile metal extending along the side edges thereof and having two generally parallel faces extending between said side edges thereof;

sintering said compact to form a bordered ingot;

rolling the bordered ingot in a direction parallel to said borders by applying rolling force to said generally parallel faces whereby the thickness of said ingot is reduced while formation of edge cracks in said nonductile material is inhibited during said rolling; and trimming said borders from said ingot to form said rolled stock.

* * * * *